US005189393A

United States Patent [19]

Hu

[11] Patent Number: 5,189,393

[45] Date of Patent: Feb. 23, 1993

[54] DUAL TECHNOLOGY MOTION SENSOR

[75] Inventor: Charles C. Hu, San Jose, Calif.

[73] Assignee: The Watt Stopper Inc., Santa Clara, Calif.

[21] Appl. No.: 712,230

[22] Filed: Jun. 7, 1991

[51] Int. Cl.[5] ..... G08B 19/00

[52] U.S. Cl. ..... 340/522; 340/561; 340/554; 340/555; 367/93

[58] Field of Search ..... 340/522, 521, 506, 565, 340/561, 554, 552, 555; 367/93, 94

[56] References Cited

U.S. PATENT DOCUMENTS 3,725,888 4/1973 Solomon ..... 340/522
4,660,024 4/1987 McMaster ..... 340/522
4,882,567 11/1989 Johnson ..... 340/522
5,077,548 12/1991 Dipoala ..... 340/522

*Primary Examiner*—Donnie L. Crosland
*Attorney, Agent, or Firm*—Townsend and Townsend

[57] ABSTRACT

A dual technology sensor which uses both ultrasonic and infrared sensors is disclosed. The electronic circuit of the invention requires detection by both sensors to activate the load. Thus, false triggering will not occur unless the false triggering device both emits heat and moves. The avoid having the motion sensor inadvertently turn off while the person is still present, only one of the infrared and ultrasonic sensors is required to be detecting to maintain the activated state.

12 Claims, 4 Drawing Sheets

| | |
|---|---|
| FIG. 2A'. | FIG. 2A". |

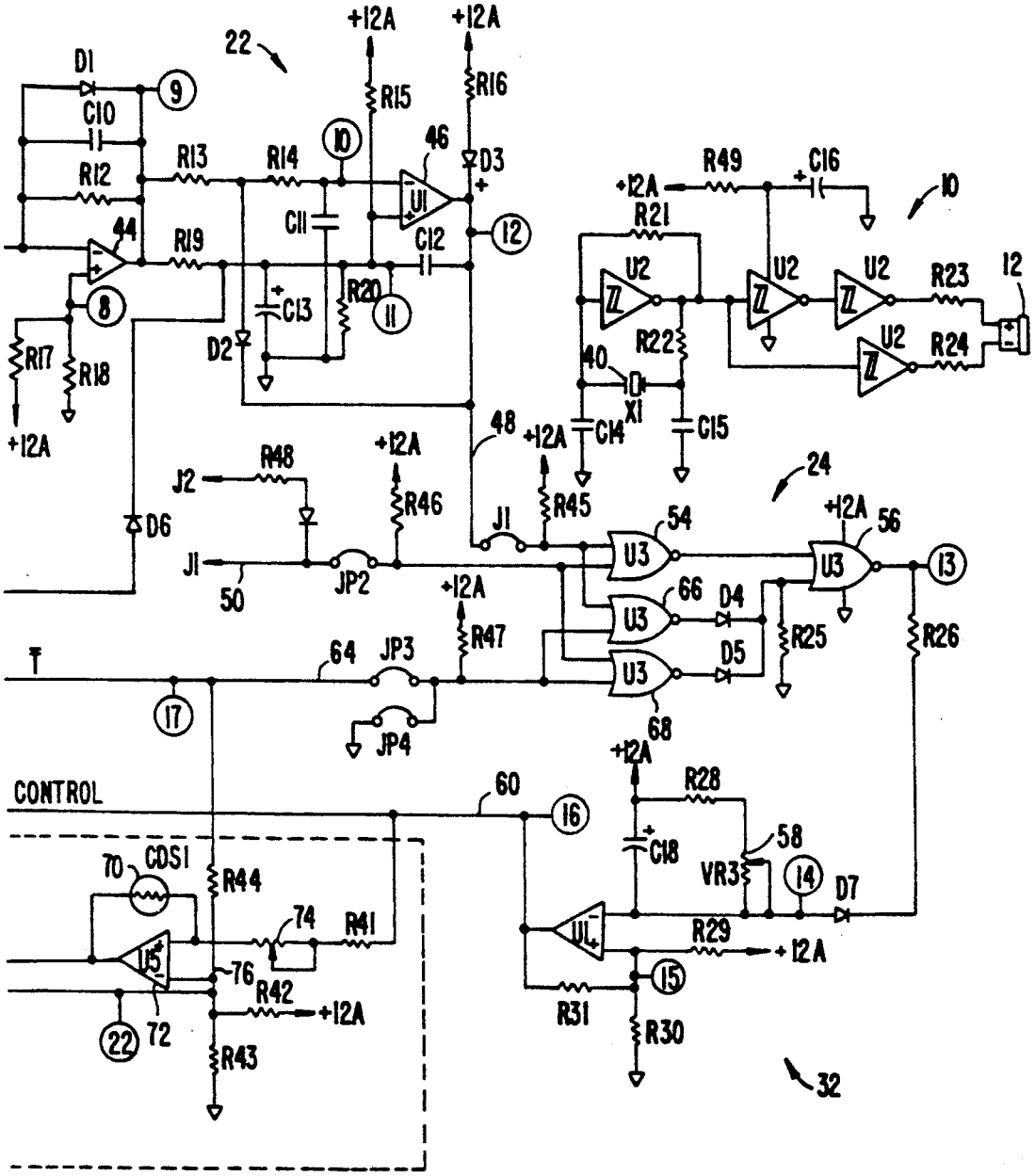
FIG. 2A."

DUAL TECHNOLOGY MOTION SENSOR

BACKGROUND

The present invention relates to motion sensors for detecting movement in a room and activating lights or other apparatus accordingly.

A variety of sensors detect the presence of people in a room for the purpose of automatically turning on lights or other devices. Such sensors will also turn off the lights upon detecting that no one is in the room or area for a predetermined amount of time. One such system uses an ultrasonic transmitter and receiver, such as the one disclosed in U.S. Pat. No. 4,820,938. The ultrasonic signal received will show the presence of a person by the Doppler effect, i.e., the change in the frequency of the ultrasonic waves received, indicating movement of the person off whom the waves are bouncing. One disadvantage of this system is the false triggering that will occur when there are moving objects in the room, such as a vibrating air conditioning vent or other moving objects.

Another type of sensor uses an infrared sensor which detects the heat given off by a human in the room. Again, this technology is subject to false triggers due to the heat given off by other devices, such as computers, heating vents, etc.

Accordingly, it is desirable to have a motion sensor which overcomes the false triggering disadvantages of these prior art devices. In particular, such false triggering will keep the lights or other loads on when no one is in fact present, thereby resulting in added energy costs.

SUMMARY OF THE INVENTION

The present invention provides a dual technology sensor which uses both ultrasonic and infrared sensors. The electronic circuit of the invention requires detection by both sensors to activate the load. Thus, false triggering will not occur unless the false triggering device both emits heat and moves. To avoid having the motion sensor inadvertently turn off while the person is still present, only one of the infrared and ultrasonic sensors is required to be detecting to maintain the activated state.

In the preferred embodiment of the invention, a logic circuit is used to provide an activating signal to a timer when both sensors are detecting. The timer will provide the activating signal for a predetermined amount of time, which may be set from 15 seconds to 15 minutes in one embodiment. A feedback loop provides the timer output, the activating signal, back to the logic circuit. The feedback loop provides the signal back only after a time delay to prevent it from causing a trigger itself. This feedback signal is then combined separately with the ultrasonic and infrared sensor signals to maintain the input the timer in an active state with either one after there has been an initial trigger.

Another aspect of the invention provides a photo sensor for detecting the light level in the room when the motion sensor is providing the activating signal. This circuit will provide an output control signal if the light level is too high. This type of a circuit may be used for activating different banks of lights, for instance, to provide the minimum number of lights necessary when there are other sources of lighting, such as sunlight through the windows. The threshold value for the amount of light desired is adjustable.

For a fuller understanding of the nature and advantages of the invention, reference should be made to the ensuing detailed description taken in conjunction with the accompanying drawings.

DETAILED DESCRIPTION OF THE PREFERRED EMBODIMENTS

Figure 1:
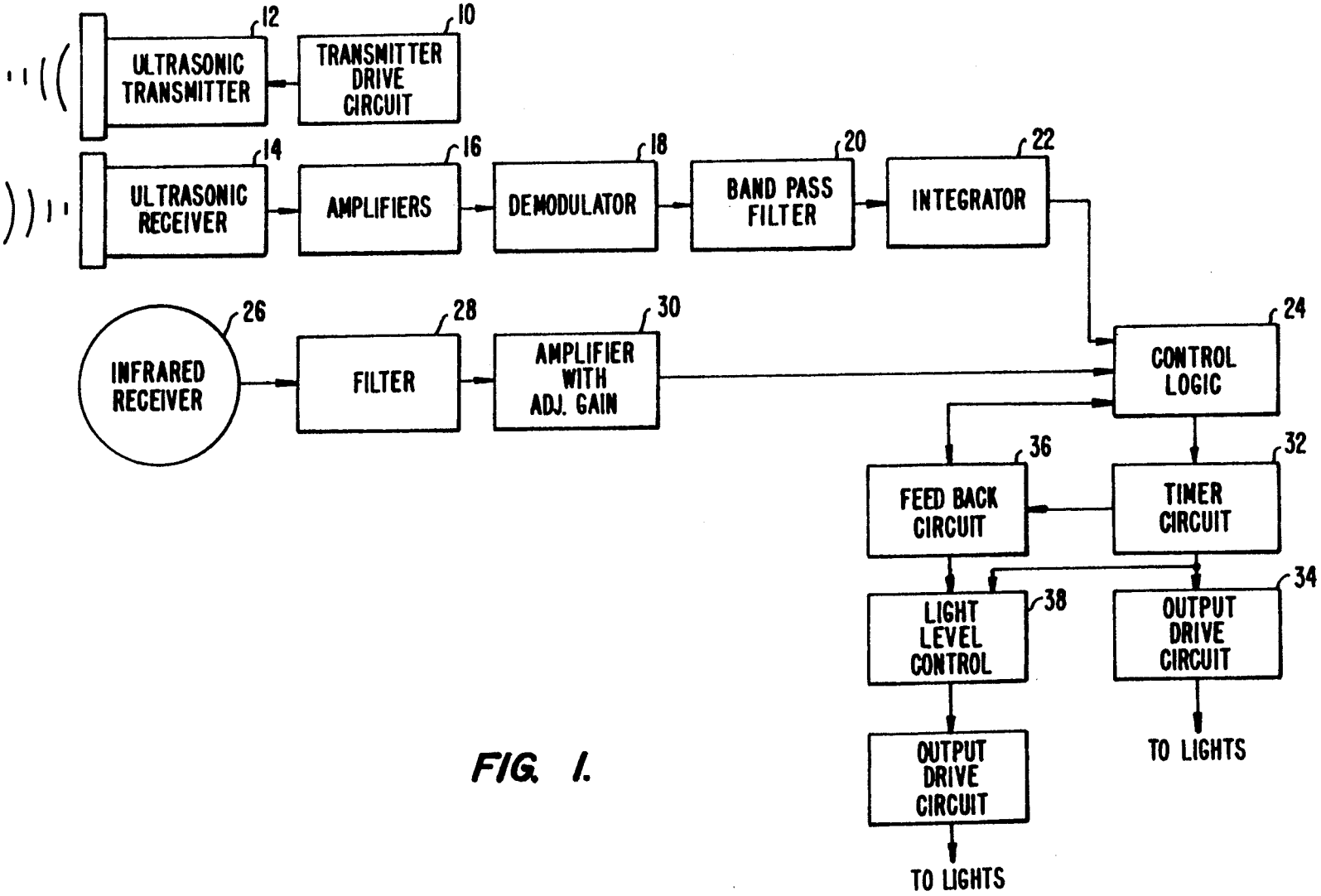
FIG. 1 is a block diagram of a motion sensor system according to the present invention.

FIG. 1 shows a dual technology motion sensor system according to the present invention. A transmitter drive circuit 10 provides a signal to an ultrasonic transmitter 12 which emits ultrasonic waves at a predetermined frequency. An ultrasonic receiver 14 receives the ultrasonic waves as they reflect off objects in the area where the motion sensor is mounted. The signal is passed through amplifiers 16, demodulator 18, band pass filter 20 and integrator 22. These circuits will detect the presence of motion causing a Doppler effect in the signal received. The output signal indicating the presence of motion is provided to control logic 24.

A separate, passive infrared receiver 26 will detect heat in the area. The output of the infrared receiver 26 will be provided through a filter 28 and an amplifier with adjustable gain 30 to a second input of control logic 24.

Control logic 24 provides an enabling signal to a timer circuit 32 when activating signals are detected from both sensors. Timer circuit 32 provides a signal to an output drive circuit 34, which is coupled to the lights or other load. Thus, whenever there is an activating signal, it will be maintained for a minimal period of time as determined by the timer circuit.

A feedback circuit 36 provides the signal back to control logic 24, which enables the control logic to maintain the activating state of the output when only one of the receivers 14 and 26 are detecting.

A light level control circuit 38 is connected to the feedback circuit and to the timer circuit. This circuit provides a separate output signal which can be externally connected to deactivate a portion of the lights when the detected light level is above an adjusted threshold.

Figure 2A:
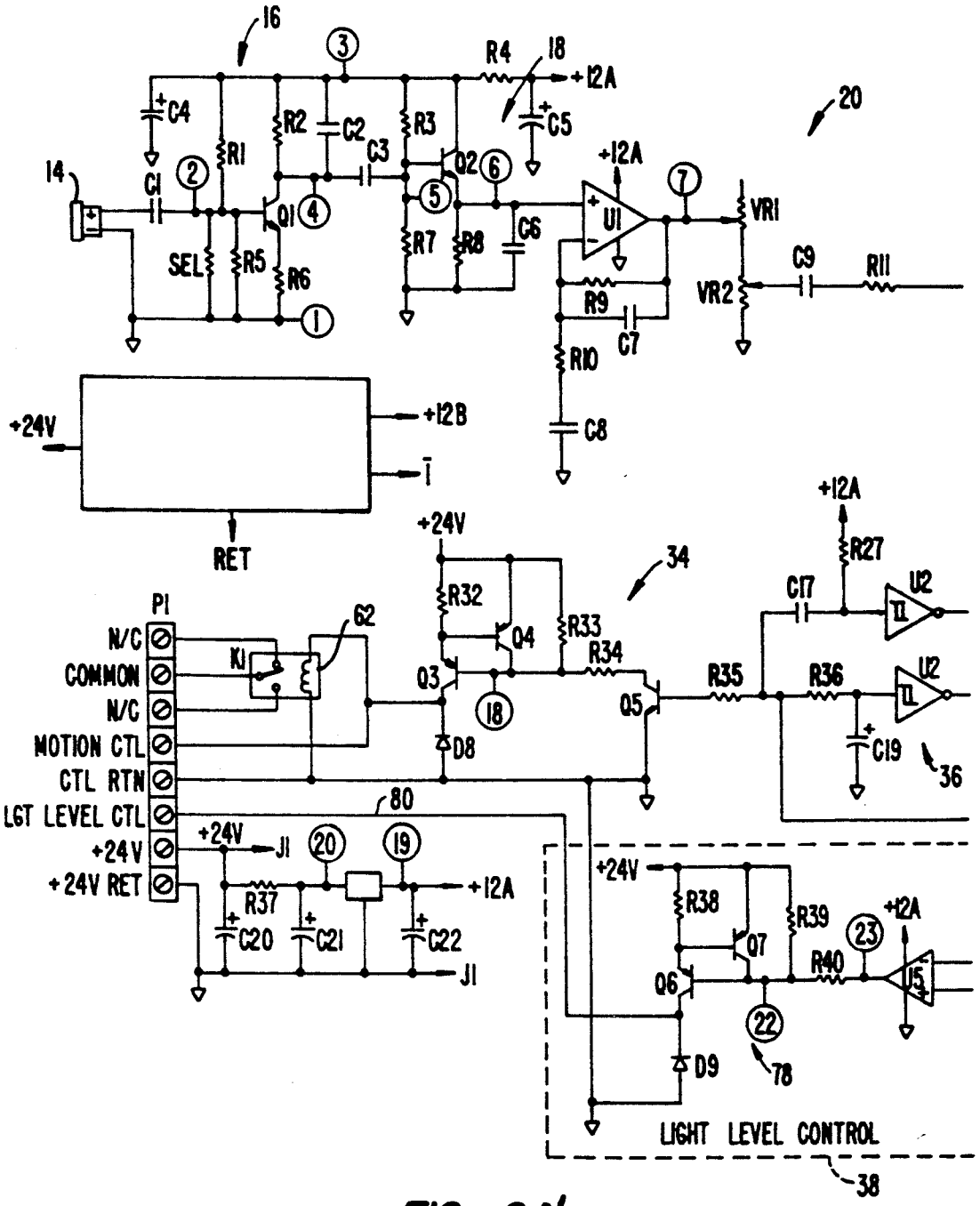
FIGS. 2A and 2 B are a circuit diagram of the system of FIG. 1.
Figure 2B:
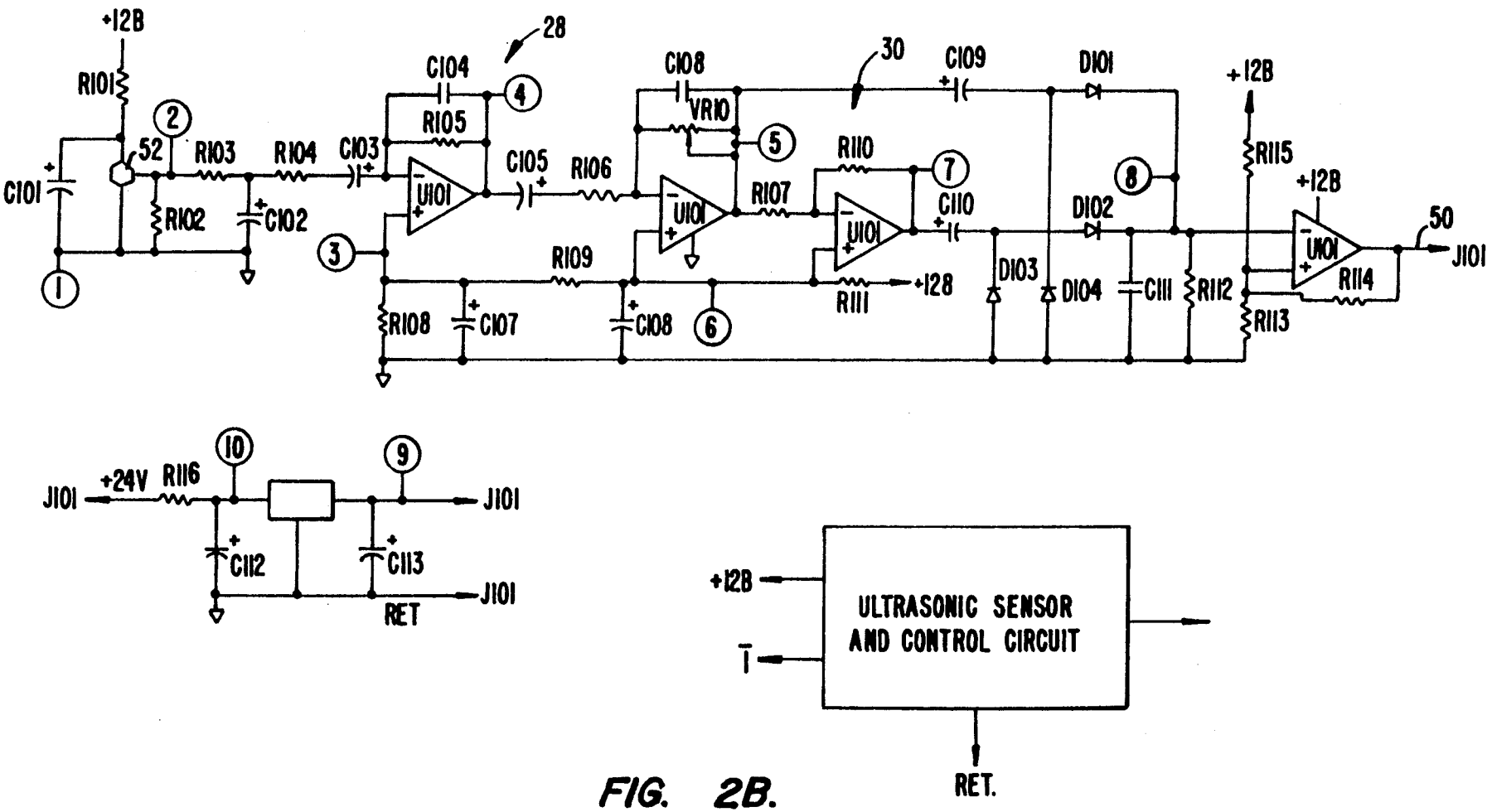

FIG. 2 is a detailed circuit diagram of one embodiment of the system of FIG. 1. Ultrasonic transmitter 12 is powered by a drive circuit 10 which includes a crystal oscillator 40. The signal is detected by ultrasonic receiver 14. Amplifier 16 is centered around transistor Q1, with demodulator 18 being centered around transistor Q2, which also provides amplification. A pair of operational amplifiers 42 and 44, and their surrounding circuitry, form two stages of band pass filter 20. Integrator circuit 22 uses operational amplifier 46 and the surrounding circuitry. This integrator circuit looks for a series of adjacent pulses, indicating motion, before it will produce an activating signal on an output line 48. Output line 48 is one input to control logic circuit 24. Another input, on line 50, is provided from the infrared receiver circuit portion shown in FIG. 2B.

Referring to FIG. 2B, a PIR (infrared) sensor 52 is connected to a filter 28 and an amplifier with adjustable gain 30 to provide signal line 50, which is an input to logic 24 in FIG. 2A.

Returning to FIG. 2A, lines 50 and 48 are provided as inputs to a NOR gate 54. Only when both signals are present, will an activating signal be provided to a second NOR gate 56. This will provide an output to the input of a timer circuit 32. The setting of the timer circuit is variable from 15 seconds to 15 minutes through the use of a potentiometer 58. The output of timer circuit 32 on line 60 is normally low, and goes to a high state when triggered. This high state is provided to output drive circuit 34 which is connected to the load through a relay 62 and a direct voltage output.

A feedback circuit 36 provides feedback on a line 64 to inputs of NOR gates 66 and 68. The other inputs of the NOR gates are provided from lines 48 and 50, respectively, which are derived from the ultrasonic and infrared sensors. Thus, if, after activation, there is still an ultrasonic signal present, the output of NOR gate 66 will be active. On the other hand, if there is a infrared signal present, the output of NOR 68 will be active. Either one of these outputs will provide an activating input to NOR gate 56. An OR function of the outputs of NOR gates 66 and 68 is provided by diodes D4 and D5 and resistor R25.

Feedback circuit 36 will only provide a signal after approximately 5 seconds after the activating signal on line 60 is triggered high. This 5 second delay is provided through resistor R36 and capacitor C19. This delay ensures that there will be no false triggering.

As can be seen, FIG. 2A shows a number of jumpers, JP1–JP4. For normal operation, all of these jumpers will be connected except JP4. By eliminating either jumper JP1 or JP2, the sensor can be turned into only an infrared sensor or only an ultrasonic sensor, respectively. By eliminating jumper JP3 and connecting jumper JP4, the system can be initially triggered through NOR gates 66 or 68 without there having to have been a previous activation of the timer circuit. Thus, either one of the ultrasonic and infrared sensors could provide the initial activation. By eliminating both jumpers JP3 and JP4, both the ultrasonic and the infrared sensor are required for initially turning on and for maintaining the activating signal in an active state. Eliminating both JP3 and JP4 effectively eliminates NOR gates 66 and 68 as possible activating inputs, allowing only NOR gate 54 to provide the activating input when both sensors are detecting.

FIG. 2A also includes a light level control circuit 38. This circuit includes a photo sensor 70 which is provided as one input to a comparator 72. The level of the signal required to activate the comparator output is controlled by a potentiometer 74. The other end of potentiometer 74 is tied through resistor R41 to output line 60 of timer 32. Thus, only when the output signal is high will the resistance from sensor 72 have an opportunity to provide an active signal at the output of comparator 72. This value is compared to the feedback value on input 76 from the output of feedback circuit 36. This level is set to provide a 2 volt threshold when the active feedback signal is present on line 64. The comparator output will be provided to output drive circuit 78 which is connected to a light level control output line 80. This line can be connected by the user to one or more banks of lights which will be turned on when the light level is too low.

As will be understood by those familiar with the art, the present invention may be embodied in other specific forms without departing from the spirit or essential characteristics thereof. For example, AND gates or other logic can be used in place of the NOR gates of logic circuit 24 of FIG. 2A. Accordingly, the disclosure of the preferred embodiment of the invention is intended to be illustrative, but not limiting, of the scope of the invention which is set forth in the following claims.

What is claimed is:

1. A motion sensor for detecting motion and providing an activating signal to a load, comprising:
   - an ultrasonic transmitter;
   - an ultrasonic receiver for generating a first detection signal;
   - an infrared receiver for generating a second detection signal;
   - means for generating said activating signal when both said first and second detection signals are present;
   - means for maintaining said activating signal when only one of said first and second detection signals are present;
   - a photo sensor for producing a third detection signal; and
   - means for deactivating said activation signal when said third detection signal is beyond a predetermined threshold.

2. The motion sensor of claim 1 further comprising means for adjusting said predetermined threshold.

3. The motion sensor of claim 1 wherein said means for generating includes first logic means for providing an AND function of said first and second detection signals.

4. A motion sensor for detecting motion and providing an activating signal to a load, comprising:
   - an ultrasonic transmitter;
   - an ultrasonic receiver for generating a first detection signal;
   - an infrared receiver for generating a second detection signal;
   - means for generating said activating signal when both said first and second detection signals are present;
   - means for maintaining said activating signal when only one of said first and second detection signals are present;
   - a timer circuit, coupled to said means for generating, for maintaining said activating signal for a predetermined amount of time; and
   - a feedback circuit, included in said means for maintaining and coupled to an output of said timer circuit, for providing a delayed signal to said means for generating.

5. The motion sensor of claim 4 further comprising means for adjusting said amount of time.

6. A motion sensor comprising:
   - an oscillator;
   - a first driver coupled to an output of said oscillator;
   - an ultrasonic transmitter coupled to an output of said first driver;
   - an ultrasonic receiver;
   - a second amplifier coupled to an output of said ultrasonic receiver;
   - a filter coupled to said second amplifier;
   - an infrared receiver;
   - a third amplifier coupled to an output of said infrared receiver;
   - first logic means, having inputs coupled to said second and third amplifiers, for producing an ON signal in response to an active output of both of said second and third amplifiers;

second logic means, having a first input coupled to an output of said first logic means to receive said ON signal, and a second input, for producing an output signal in response to said ON signal and an active signal at said second input;

a timer circuit, having an input coupled to an output of said second logic means, for producing a timed signal for a predetermined amount of time;

a driver signal, having an input coupled to an output of said timer circuit, for providing an activating signal to a load;

a delayed feedback circuit, having an input coupled to said output of said timer circuit, for producing a feedback signal after a predetermined delay; and third logic means, having inputs coupled to an output of said delayed feedback circuit, said output of said second amplifier and said output of said third amplifier, for providing an active signal to said second input of said second logic means in response to said feedback signal and a signal from one of said second and third amplifiers.

7. A motion sensor for detecting motion and providing an activating signal to a load, comprising:

an ultrasonic transmitter;

an ultrasonic receiver for generating a first detection signal;

an infrared receiver for generating a second detection signal;

means for generating said activating signal when both said first and second detection signals are present, said means for generating including first logic means for providing an AND function of said first and second detection signals; and means for maintaining said activating signal when only one of said first and second detection signals are present, said means for maintaining including second logic means for producing an AND function of said first detecting signal and a maintaining signal, third logic means for producing an AND function of said second detection signal and said maintaining signal, fourth logic means for producing an OR function of said second and third logic means, and fifth logic means for producing an OR function of said first logic means and said fifth logic means.

8. The motion sensor of claim 7 wherein said maintaining signal is produced by a feedback signal from a feedback circuit coupled to receive said activating signal.

9. A motion sensor for detecting motion and providing an activating signal to a load, comprising:

an ultrasonic transmitter;

an ultrasonic receiver for generating a first detection signal;

an infrared receiver for generating a second detection signal;

means for generating said activating signal when both said first and second detection signals are present;

means for maintaining said activating signal when only one of said first and second detection signals are present;

a photo sensor for producing a third detection signal;

means for deactivating said activation signal when said third detection signal is beyond a predetermined threshold;

a timer circuit, coupled to said means for generating, for maintaining said activating signal for a predetermined amount of time; and a feedback circuit, included in said means for maintaining and coupled to an output of said timer circuit, for providing a delayed signal to said means for generating.

10. The motion sensor of claim 9 further comprising means for adjusting said amount of time.

11. The motion sensor of claim 10 further comprising means for adjusting said predetermined threshold.

12. The motion sensor of claim 9 wherein said means for deactivating includes a comparator having a first input coupled to an output of said timer circuit and a second input coupled to an output of said feedback circuit.

* * * * *